US005454755A

United States Patent [19]

Sweeny et al.

[11] Patent Number: 5,454,755

[45] Date of Patent: Oct. 3, 1995

[54] WINDOW VENTILATOR

[76] Inventors: H. Dermot Sweeny; Thomas W. Schaffner, both of C/O Swenco Limited, 560 Conestogo Rd., Waterloo, Ontario, N2L 4E3, Canada

[21] Appl. No.: 227,236

[22] Filed: Apr. 13, 1994

[51] Int. Cl.[6] ..... E06B 7/06

[52] U.S. Cl. ..... 454/220; 454/216

[58] Field of Search ..... 454/214, 215, 454/216, 220, 226; 403/408.1, 406.1, 381, 263, 262, 337, 382, 376; 312/263, 264, 265, 265.5

[56] References Cited

U.S. PATENT DOCUMENTS

| | | | |
|---|---|---|---|
| 148,861 | 6/1913 | Fisher . | |
| 948,417 | 2/1910 | Dunlap | 454/220 |
| 1,224,818 | 5/1917 | White | 454/216 |
| 2,051,997 | 8/1936 | Maynard | 454/220 |
| 3,124,055 | 3/1964 | Rubera | 454/220 |

FOREIGN PATENT DOCUMENTS

| | | | |
|---|---|---|---|
| 449739 | 7/1948 | Canada . | |
| 465612 | 6/1950 | Canada . | |
| 492545 | 5/1953 | Canada | 454/220 |

*Primary Examiner*—Harold Joyce
*Attorney, Agent, or Firm*—Jones, Tullar & Cooper

[57] ABSTRACT

A ventilator for slider type windows is provided, the ventilator having triangular end members and one or more bridging members extending therebetween. The ventilator is positionable between fixed and movable portions of the window and deflects incoming air upwardly or to the side. Each bridging member is provided with a pair of rib portions, each having a partially enclosed slot running the length thereof. Each end member has a slot adapted to receive the end face of a bridging member and has a pair of holes extending therethrough in alignment with the corresponding slots of the bridging member received therein. A screw extends through each hole and is threaded into the adjacent bridging member slot to secure the bridging member to the end member. The ventilator is particularly useful with combination storm and screen windows or doors. The ventilator can be packaged with all components flat and can be assembled and disassembled with ease.

12 Claims, 3 Drawing Sheets

WINDOW VENTILATOR

The present invention relates to ventilation devices in general and in particular to such a device that can be used with vertical or horizontal sliding windows, and is especially effective with combination storm and screen windows or doors.

BACKGROUND OF THE INVENTION

Most original and replacement windows for modern residential buildings are of either the casement or the sliding variety, with either vertical or horizontal movement for opening and closing the window. Casement type windows provide for automatic deflection of incoming air due to the pivoting nature of their actuation. Slider type windows on the other hand do not provide for any deflection of incoming air. Similarly, if the window is open during a rain storm there is a strong likelihood that rainwater will enter the room and puddle on the floor.

Older homes, such as those built before 1950, contained mostly double hung windows. Older styles of storm windows and screen frames were usually hung or attached to the exterior frame and were changed from season to season. These were gradually replaced with relatively inexpensive extruded aluminum "combination storm and screen" windows, custom fitted to the exterior frames. These still exist on the majority of older homes in the upper half of North America. Although many environmentally superior replacement windows are available today, they are very expensive and are limited in application to those people that can afford to have them installed. The combination storm and screen windows mentioned above are still manufactured and find a ready market in the older homes in inner cities and rural towns and villages.

Over approximately the same period, older style separate storm doors and screen doors have been replaced with the same general design of "combination storm and screen" doors, manufactured from aluminum extrusions.

Combination storm and screen windows and doors permit an almost infinite adjustment of opening up to the limit of screening and are usually controlled by spring friction or by using spring loaded adjustable stops. While this type of window or door satisfies an important need, they lack the ability to permit a small opening of, say, 2 to 3 inches during a rain storm, thereby necessitating closure of the windows or doors, at least on the windward side of the residence. When at home, this closing function can be done by the occupants. However, in the occupant's absence, or while sleeping (and particularly in babies' or small children's bedrooms) a sudden rain storm can cause entry of water and the consequent damage to floors, not to mention the general disturbance to the household.

Upstairs windows, in particular, may not be left open during the day to relieve the usually higher temperature found in the upper floors of older homes. For this reason, one must remember to close such windows before all occupants depart the residence. Senior citizens and those with physical impediments may have great difficulty in acting promptly to close such windows in the event of sudden rain storm and may tend to leave such windows closed during times of inclement weather or threatening forecasts.

Aside from the consequences described above the need exists to allow indirect ventilation of rooms, especially bedrooms, to avoid draughts, particularly in early spring or late fall when fresh air is needed, but that same air is cooler than normal summer air. Occasional ventilation is needed sometimes in the winter or in more temperate zones and a means of deflecting such incoming air is useful and convenient.

There have been attempts in the past to produce ventilators for sliding window but they have all been deficient in one way or another. Prior art ventilators are found for example in Canadian Patents Nos. 148,861 (Fisher) of Jun. 2, 1913; 449,739 (Eichenberger) of Jul. 13, 1948; 465,612 (Allen) of Jun. 6, 1950; and 492,545 (Shelley) of May 5, 1953.

SUMMARY OF THE INVENTION

The present invention meets the above criteria with a simple, inexpensive ventilator that any person can install in a slider type window. The ventilator of this invention uses a pair of generally triangular end members and a bridging member that extends between the end members. The bridging member is thin and can be extruded from a plastics material. the bridging member has a pair of longitudinally extending spaced apart rib members parallel to a long edge thereof on one side, with each rib member containing a partially enclosed slot which enters the rib member from the opposite side of the bridging member. Each end member has a slot adjacent one of the long edges thereof, which slot has a profile corresponding to the outer profile of the bridging member. Each end member slot thus includes an enlarged area for reception of the end of each rib member and there is an opening through the end member at each enlarged area for reception of a threaded fastener, such as a self-tapping machine screw. When the bridging member is assembled to an end member a screw is passed through each opening in the end member and is threaded into the respective slot of the bridging member to secure the bridging member to the end member. In this way the components can be packaged in an unassembled, flat condition, and they can be stored in the same condition during the winter months. The threaded fastener technique allows for quick assembly and disassembly a multitude of times and permits wider tolerances during manufacture.

The above describes the most basic embodiment of the invention. The bridging member could be supplied in a standard length of, say, one meter, and the homeowner could easily cut the member to the desired length with a hacksaw or any good wood saw. Another embodiment has the bridging member provided with a pair of ribs on the same side as the slot openings with the ribs of one bridging member being receivable in the slots of another bridging member so as to achieve adjustability of length. Although it would be preferable to only use a pair of telescoping bridging members for the average installation there would be nothing preventing the telescoping assembly of three or more bridging members to attain a ventilator of almost any desired length. Of course, as the length increases the stability of the ventilator will decrease due to the increased unsupported length.

Broadly speaking therefore the present invention provides a ventilator device for a slider type window comprising a pair of generally right-triangular end members and a bridging member extendable between the end members, the bridging member having rib portions extending along one side parallel to one long edge thereof, with a partially enclosed slot extending into each rib portion from the opposite side of the bridging member, and each end member having a slot adjacent one of the long edges thereof, the end member slot conforming in shape to the end profile of the bridging member and having an enlarged area corresponding to the end face of each rib portion, with an opening through the end member at each enlarged area aligned with the corresponding partially enclosed slot for reception of a threaded fastener threadable into the partially enclosed slot to secure the end member to the bridging member.

The present invention also provides a ventilator device for positioning within a slider type window between fixed and movable frame portions thereof, the device comprising: a pair of generally right-triangular end members and a pair of bridging members telescopically extendable between the end members; each of the bridging members having a pair of rib portions extending along one side parallel to one long edge thereof, a generally diamond-shaped slot extending into each rib portion from the opposite side of the bridging member, and a pair of generally triangular rib members extending along the opposite side of the bridging member parallel to the one long edge: and each end member having a slot adjacent one of the long edges thereof, each end member slot conforming in shape to the end profile of the bridging member to be received therein and having pairs of first and second enlarged areas to accommodate the end faces of the rib portions and rib members respectively, with an opening through the end member at each first enlarged area aligned with the corresponding diamond-shaped slot of a bridging member for reception of a threaded fastener threadable into the diamond-shaped slot to secure the end member to one of the bridging members.

DESCRIPTION OF THE PREFERRED EMBODIMENT

Figure 1:
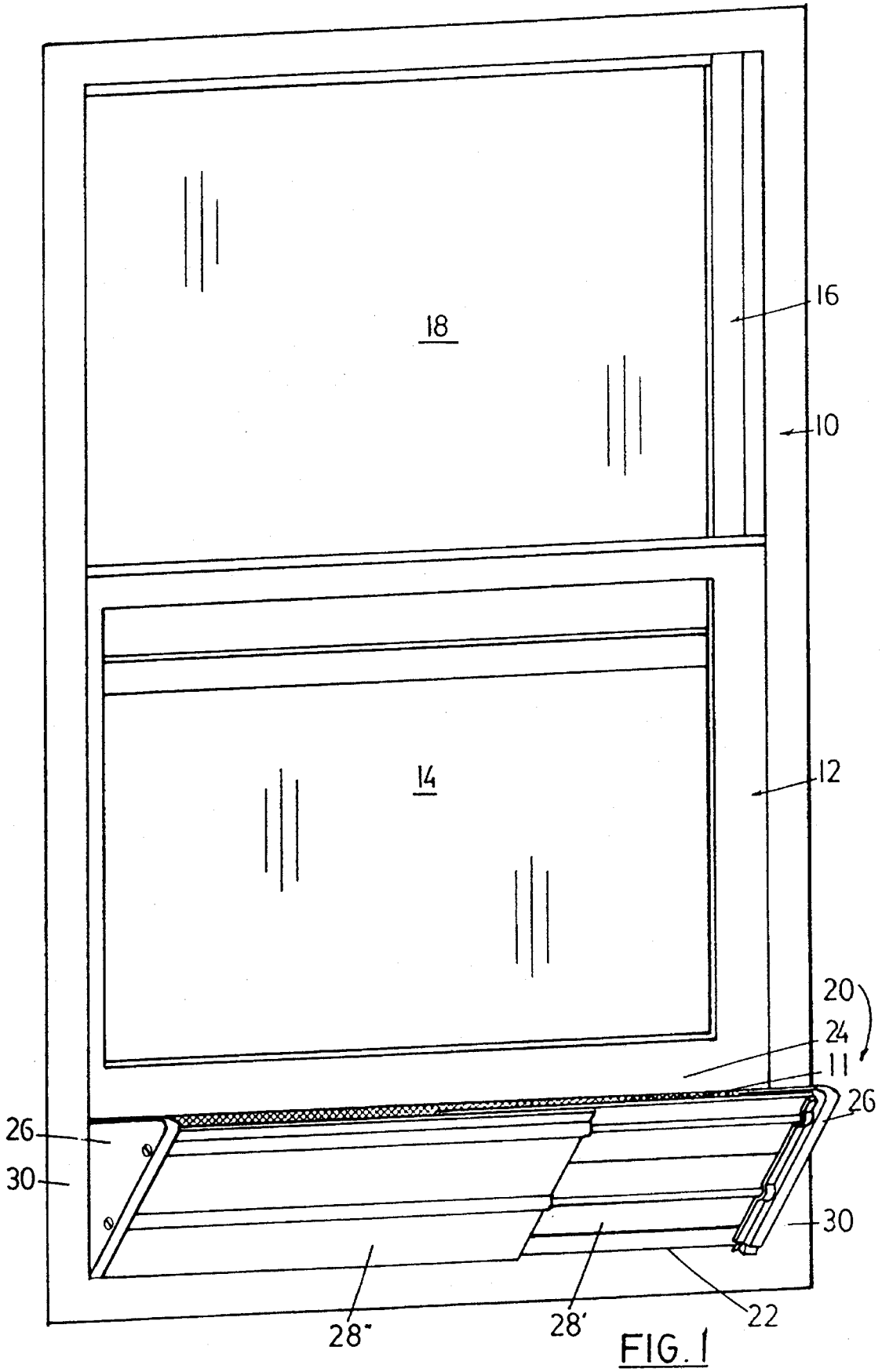
FIG. 1 shows a typical vertical slider type window with a ventilator of the present invention in place.

FIG. 1 illustrates a typical vertical slider type window such as a storm window and screen combination as might be found in a storm door, for example. The combination includes a peripheral frame 10, a slider frame 12 containing window glass 14, a fixed screen 11 and a fixed or slidable frame 16 containing window glass 18. The window does not form part of the invention and, in fact, the invention is operable with a horizontal slider type window as well.

The ventilator 20 of the present invention is shown in position between the sill 22 and the bottom frame or sash member 24 of the slider frame 12. The ventilator 20 includes a pair of end members 26 and a pair of relatively slidable or telescopic bridging members 28',28" between the end members 26. As seen in FIG. 1 the bridging members 28',28" telescope together so that the end members 26 can be positioned against the vertical frame members 30,30.

Figure 2:
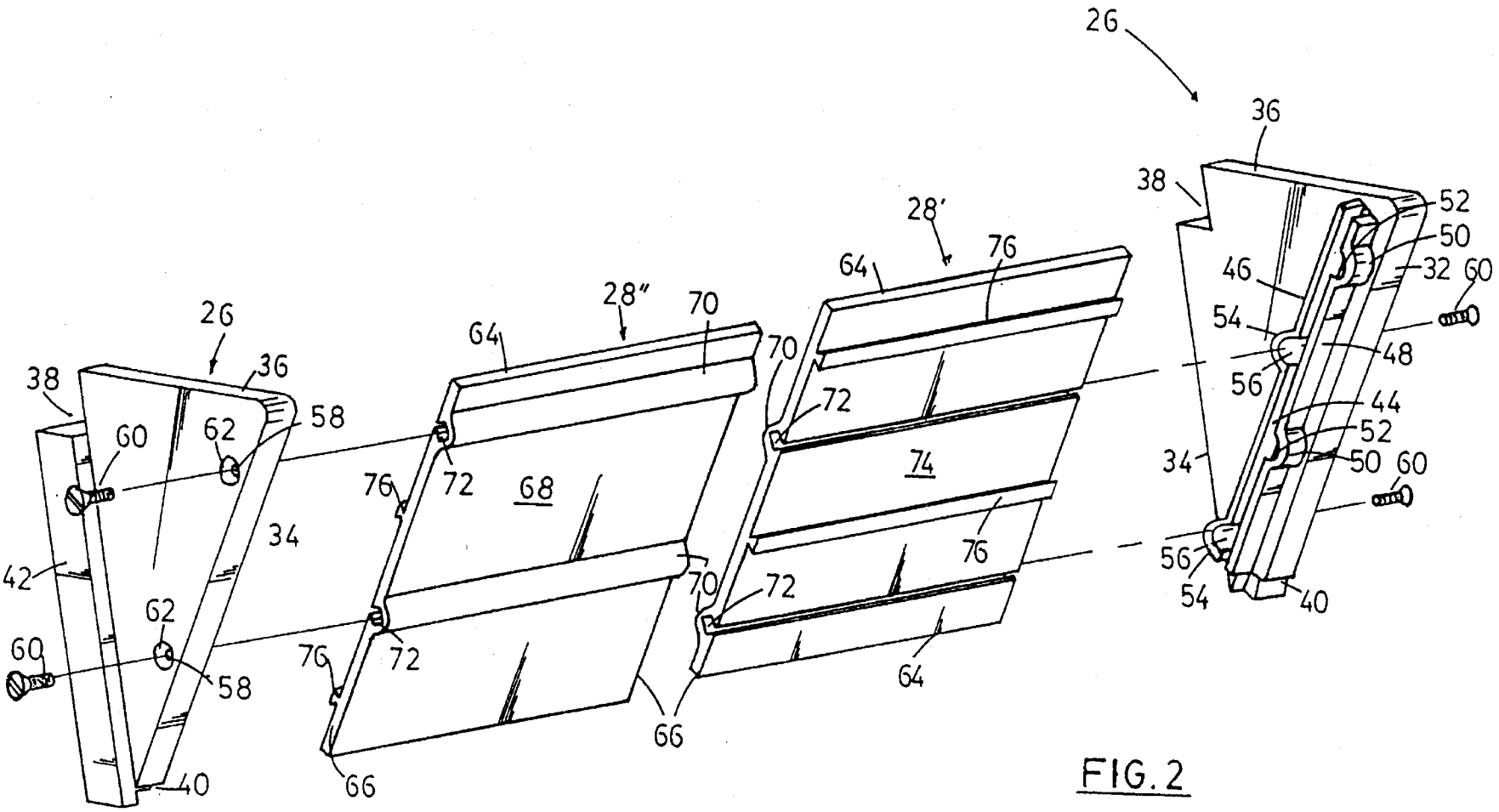
FIG. 2 is an exploded perspective view showing the components of the invention.

FIG. 2 shows an exploded view of the components use in the FIG. 1 configuration. It is seen for example that each end member 26 has a shape that is generally fight-triangular, there being two long edges 32,34 and a short edge 36 that meets the edge 32 at substantially a right angle. Two of the vertices are provided with cut out sections 38,40 for reception of the window frame member 24 and for reception in or against the sill 22 respectively. A strengthening rib or flange 42 extends along the edge 32 and projects laterally outwardly therefrom. On the opposite side of the end member is a slot 44 defined by raised ribs or flanges 46,48, the slot 44 being adapted to receive the end of a respective bridging member 28',28". The flange 48 includes two semicircular portions 50,50 which define enlarged areas 52,52 within the slot 44. Other semicircular portions 54,54 define enlarged areas 56,56 within the slot 44. Each enlarged area 56 includes an opening 58 that extends through the end member 26 and is adapted to receive a fastener such as a self-tapping machine screw 60. The opening or hole 58 can have a countersunk area 62 on the outside of the end member so that the head of the screw 60 will not be exposed above the surface of the end member. Preferably the end members 26 will be injection molded from a thermoplastic material.

The bridging members 28',28" are also shown in FIG. 2. The members are identical to each other but, when they are assembled together one is turned upside down and back to front relative to the other so that they can be telescoped together. Therefore only the member 28' will be described in full.

The bridging member 28' is elongate, with parallel long edges 64,64 and end edges 66,66. The member is extruded from a plastics material and has on one side 68 thereof a pair of longitudinally extending rib portions 70,70 parallel to the long edges 64,64 with one of the rib portions 70 being closer to a long edge 64 than the other rib portion 70. A partially enclosed slot 72 extends into each rib portion 70 from the opposite side 74 of the bridging member. Each slot 72 extends for the full length of the bridging member and in the embodiment as illustrated it has a square or diamond-shaped transverse profile, opening to the opposite side 74 of the bridging member along one vertex of that profile. A pair of rib members 76,76 is provided on the side 74 of the bridging member, the rib members being parallel to the rib portions 70,70 and having the same spacing therebetween and orientation on the bridging member so that when the bridging members are brought together in a telescoping relationship the rib members 76,76 of one bridging member will be received within corresponding slots 72,72 of the other bridging member, with their long edges 64,64 being coplanar. As seen in FIG. 2 the rib member 76 has an inverted triangular profile which fits snugly within the diamond-shaped profile of the slot 72, the angled sides of the rib member sliding on the angled sides of the slot and the widest part of the rib member extending between the laterally opposed vertices of the slot. These profiles are convenient to extrude, but it is understood that other mating profiles would work equally well without departing from the intent of the invention. Circular profiles for example would be acceptable.

One important feature of the present invention is seen in FIG. 2 wherein the each of the openings or holes 60 is shown to be in alignment with a corresponding slot 72 of the bridging member to be received in the end member slot 44. For assembly of an end member to a bridging member one need only insert the bridging member into the slot 44 and then to drive a screw 62 through the opening 60 into the slot 72 so that the self-threading property of the screw will securely fasten the end member to the bridging member. With two screws in place the components are tightly fastened together with no chance of separation. Furthermore the end member and the bridging member can be disconnected for winter storage. Of course the maximum size of the slot 72 is smaller than the diameter of the screw 62 so that the threads of the screw will bite into the material of the bridging member to hold the components together. A diamond-shaped (or square) slot is preferred because the plastic material is displaced into the corners as the screw is threaded into the slot. This allows repeated assembly and disassembly, something that might not be as available with circular slots, which tend to gall after repeated use.

When the end members have been assembled, one to each bridging member, the bridging members 28',28" are telescoped together with the rib members 76,76 of the bridging member 28' received in the slots 72,72 of the bridging member 28" and the fib members 76,76 of the bridging member 28" received in the slots 72,72 of the bridging member 28'. The assembled ventilator 20 may then be positioned in any convenient window as illustrated in FIG. 1. As indicated earlier, one significant application for this invention is in association with the vertically slidable window sections of aluminum combination storm and screen windows or doors. The ventilator can be locked in place between the slidable window and the surrounding frame or track so that any incoming breeze is directed upwardly to prevent draughts and so that any rain entering through the screen is prevented from entering the dwelling and falling to the floor. This allows the homeowner to use the combination storm and screen window or door even in inclement weather so as to obtain the ventilating advantages thereof.

While the invention has been described and illustrated with respect to vertically slidable windows, it is also useful with horizontal sliding type window. In such an application the ventilator of the invention would be oriented vertically with the cut out 40 positioned in a vertical portion of the peripheral window frame and the cut out 38 receiving the vertical edge of the sliding window frame of the window.

Figure 3:
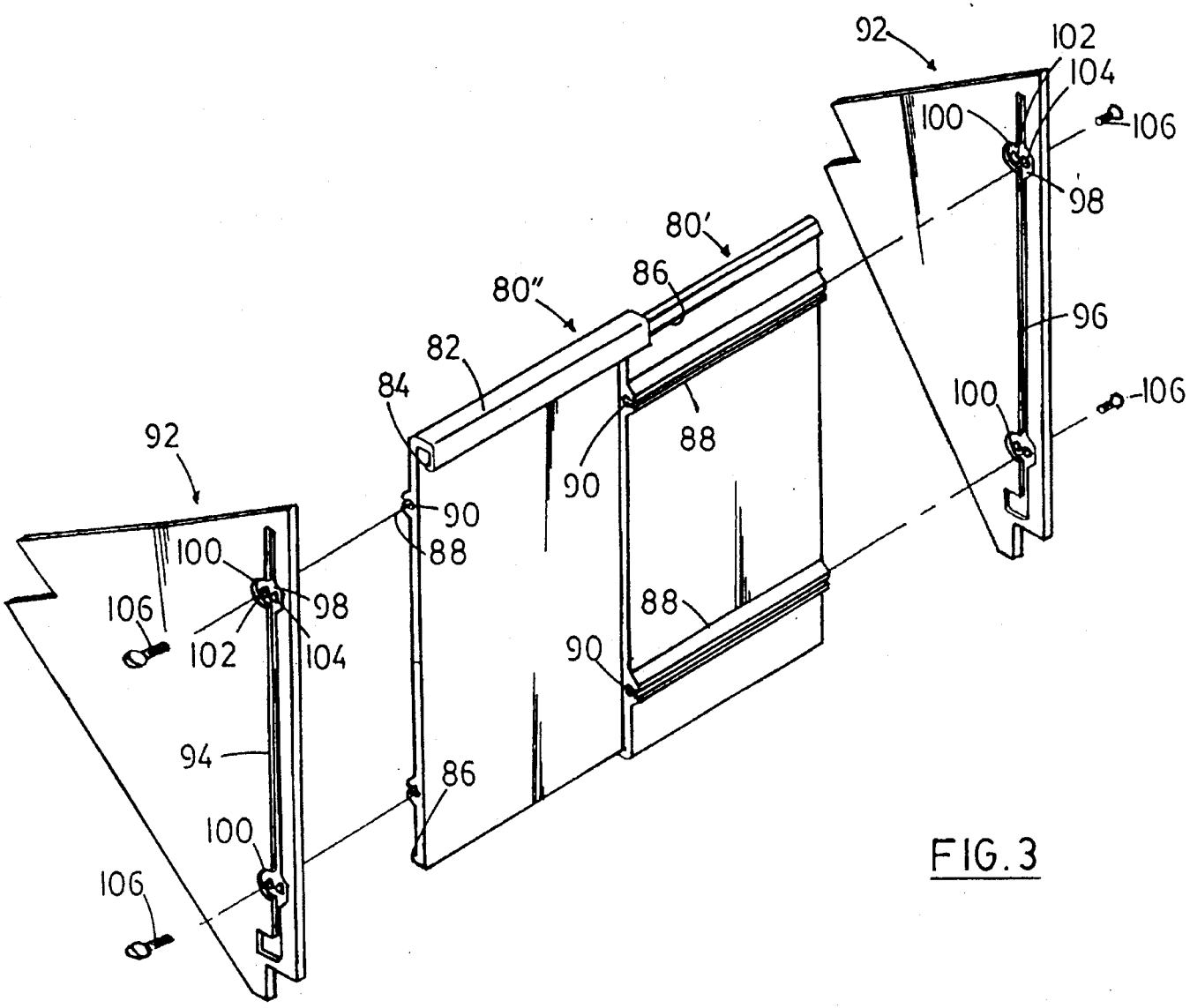
FIG. 3 is an exploded perspective view of another embodiment of the present invention.

FIG. 3 shows another variation of the present invention although the principles thereof are unchanged. In this embodiment each bridging member 80'80" has a reentrant J-shaped flange 82 extending along one long edge thereof with the flange defining an opening 84 for receiving the other long edge of the other bridging member. That other long edge may optionally have a small locking ridge 86 receivable within the flange 82 to further prevent unwanted separation of the bridging members. Each bridging member has a pair of parallel spaced apart rib portions 88 extending the length thereof, with each rib portion having a partially enclosed, generally circular slot 90 therein, which slot serves the same purpose as the slots 72,72 of the first embodiment.

The generally right triangular end members 92 have opposed slots 92,94 which are mirror images of each other and which are separated by a relatively thin web 96 of end member material, the slots each being dimensioned to receive an end face of a bridging member therein. Each slot 92,94 has enlarged areas 98 therein corresponding to the rib portions 88 and through holes 100, 102 alignable with the slots 90,90. Since the end members 92 are interchangeable end for end it is necessary to provide two holes at each enlarged area 98 to compensate for the offset of one bridging member and its slots 90 relative to the other. A self-tapping machine screw 104 passes through the appropriate holes 100,102 to secure the end member to the corresponding bridging member.

It is not necessary to telescope two or more bridging members together to achieve a useful ventilator. A single bridging member could extend between a pair of end members, the bridging member being provided in a relatively long section of, say, a meter or so. It could be cut to length with a hacksaw and then attached to the end members to create a non-adjustable ventilator. With the first embodiment it would be desirable to have end members in which the is no offset between the slots 44 of the left and right hand end members as there is but a singe bridging member being used. When an even number of bridging members are telescoped together the offset between the slots 72,72 of the righthandmost and the lefthandmost bridging members will have to be compensated for by slightly offsetting the slots 44 of the right and left end members. This would not be a problem with the second embodiment as there is automatic compensation through the use of two holes 100,102 at each enlarged area 98. Of course, slots formed in the manner of the slots 44 of the first embodiment could be used with the second embodiment and vice versa.

The present invention provides window ventilators which are effective, usable with practically any style of slider type window, inexpensive to produce and package, and easy to install. The foregoing has described the preferred embodiments of the invention but it is understood that variations therein may occur to a skilled person, which variations would not depart from the spirit of the inventions. Accordingly the protection to be afforded this invention is to be determined from the claims appended hereto.

We claim:

1. A ventilator device for a slider type window comprising a pair of generally right-triangular end members and a bridging member extendable between the end members, the bridging member having rib portions extending along one side parallel to one long edge thereof, with a partially enclosed slot extending into each rib portion from the opposite side of the bridging member, and each end member having a slot adjacent one of the long edges thereof, the end member slot conforming in shape to the end profile of the bridging member and having an enlarged area corresponding to the end face of each rib portion, with an opening through the end member at each enlarged area aligned with the corresponding partially enclosed slot for reception of a threaded fastener threadable into the partially enclosed slot to secure the end member to the bridging member.

2. The device of claim 1 including a pair of said bridging members, each having rib members on said opposite side, each rib member having an end profile corresponding generally to that of said partially enclosed slot for sliding reception therein, whereby said pair of bridging members can be assembled together with the rib members of each bridging member being telescopically received in the corresponding partially enclosed slots of the other bridging member.

3. The device of claim 1 wherein each said partially enclosed slot has a generally diamond-shaped end profile.

4. The device of claim 2 wherein each said partially enclosed slot has a generally diamond-shaped end profile and each rib member has an inverted generally triangular end profile with a transverse surface corresponding to the transverse dimension of the partially enclosed slot and converging side surfaces corresponding to adjacent converging side surfaces of the partially enclosed slot.

5. The device of claim 1 wherein the end profile of each said partially enclosed slot is generally circular.

6. The device of claim 2 wherein the end profile of each of said partially enclosed slots and said rib members is generally circular, such that each rib member can be slidably received within a corresponding partially enclosed slot.

7. The device of claim 1 wherein each of said end members is provided with cut-out areas at at least two of the vertices thereof for interlocking engagement with frame portions of the window in which it is to be received.

8. The device of claim 2 wherein each of said end members is provided with cut-out areas at at least two of the vertices thereof for interlocking engagement with frame portions of the window in which it is to be received.

9. A ventilator device for positioning within a slider type window between fixed and movable frame portions thereof, said device comprising: a pair of generally right-triangular end members and a pair of bridging members telescopically extendable between the end members; each of the bridging members having a pair of rib portions extending along one side parallel to one long edge thereof, a generally diamond-shaped slot extending into each rib portion from the opposite side of the bridging member, and a pair of inverted generally triangular rib members extending along the opposite side of the bridging member parallel to the one long edge: and each end member having a slot adjacent one of the long edges thereof, each end member slot conforming in shape to the end profile of the bridging member to be received therein and having pairs of first and second enlarged areas to accommodate the end faces of the rib portions and rib members respectively, with an opening through the end member at each first enlarged area aligned with the corresponding diamond-shaped slot of a bridging member for reception of a threaded fastener threadable into the diamond-shaped slot to secure the end member to one of the bridging members.

10. The device of claim 9 wherein each of said end members is provided with cut-out areas at at least two of the vertices thereof for interlocking engagement with the fixed and movable frame portions of the window in which it is to be received.

11. A ventilator device for positioning within a slider type window between fixed and movable frame portions thereof, said device comprising: a pair of identical, generally right-triangular end members and a pair of bridging members telescopically extendable between the end members; each of the bridging members having a pair of parallel rib members extending along one side parallel to one long edge thereof, a partially enclosed, generally circular slot within and extending along each rib member, and a generally J-shaped reentrant flange extending along the one long edge of the bridging member for telescopic reception of the other long edge of the other bridging member, and each end member having a pair of opposed slots adjacent one of the long edges thereof, each of the end member slots conforming in shape to the end profile of the bridging member and having a pair of enlarged areas to accommodate the end faces of the rib members, with a pair of openings through the end member at each enlarged area, each aligned with a corresponding circular slot of a bridging member for reception of a threaded fastener threadable into the circular slot to secure the end member to one of the bridging members.

12. The device of claim 11 wherein each of said end members is provided with cut-out areas at at least two of the vertices thereof for interlocking engagement with the fixed and movable frame portions of the window in which it is to be received.

* * * * *